US005339856A

United States Patent [19]

Templar

[11] Patent Number: 5,339,856

[45] Date of Patent: Aug. 23, 1994

[54] VALVE RETAINER MEANS, A METHOD OF FORMING THE SAME, AND A METHOD OF VALVE INSERTION THEREWITH

[75] Inventor: Gary A. Templar, Beaver Dams, N.Y.

[73] Assignee: Dresser-Rand Company, Corning, N.Y.

[21] Appl. No.: 148,873

[22] Filed: Nov. 8, 1993

[51] Int. Cl.[5] ..... F16K 43/00

[52] U.S. Cl. ..... 137/15; 137/315

[58] Field of Search ..... 137/15, 315, 454.2, 137/454.4, 454.5, 454.6

[56] References Cited

U.S. PATENT DOCUMENTS

| | | | |
|---|---|---|---|
| 1,041,237 | 10/1912 | Budlong | 137/454.2 |
| 1,385,467 | 7/1921 | Parsons | 137/454.6 |
| 1,411,795 | 4/1922 | Metzgar | 137/454.6 |
| 1,458,625 | 6/1923 | Metzgar | 137/454.4 |
| 2,880,748 | 4/1959 | Elsey | 137/454.6 |
| 3,658,087 | 4/1972 | Nelson | 137/454.6 |
| 4,532,955 | 8/1985 | Squires | 137/315 |
| 5,161,565 | 11/1992 | Jamieson | 137/315 |
| 5,181,692 | 1/1993 | Brausfeld | 137/315 |

*Primary Examiner*—George L. Walton
*Attorney, Agent, or Firm*—Bernard J. Murphy

[57] ABSTRACT

An annulus, with outwardly projecting limbs, comprises the blank from which a valve retainer is formed. The retainer employs the limbs to latchingly engage an internal, recessed land in a cylinder, in order to support a valve within the cylinder, while a valve cage is thereafter set into the cylinder independently. The limbs of the blank are bent into a substantially normal disposition, relative to the annulus, albeit slightly splayed outwardly to insure a resiliently-effected latching thereof with the land, and free ends of the limbs have bights formed therein to present latching surfaces for engaging the land.

7 Claims, 1 Drawing Sheet

VALVE RETAINER MEANS, A METHOD OF FORMING THE SAME, AND A METHOD OF VALVE INSERTION THEREWITH

This invention pertains to one-way valves, such as are used in gas compressors, and the like, and in particular to such valves which are used in combination with cages in gas compressor cylinders.

There are gas compressors in which, due to the design thereof, it's required that the discharge valves be installed upwardly. This circumstance, in addition to the fact that the relevant valves, and the corresponding cages therefor, are of great weight, presents a significantly difficult task. One can not simply install the valve, i.e., the discharge valve, and then set the cage into the cylinder thereafter. The valve will not remain in place, waiting for the cage to be set therein. Consequently, the two, both the valve and its cage, must be installed together; then a final valve cover can be fastened to the cylinder. As noted, the combined weights of the valve and cage challenge the servicing and/or manufacturing personnel.

What has been needed is some facile, and unobtrusive, means for holding an installed valve safely in place, in the cylinder, so that it can be emplaced independently. Then the cage installation can follow. Such accommodation for the separate installation of the two weighty components would offer a significant simplicity in manufacturing and servicing.

It is an object of this invention to set forth just such a long sought valve holding or retaining means.

Particularly, it is an object of this invention to set forth, in combination with a cylinder having an internal, recessed land, a valve retainer means, comprising first means for supportingly setting a valve thereupon; and second means, coupled to said first means, for (a) latchingly engaging the recessed land in said cylinder, and (b) upholding said first means within said cylinder.

It is also an object of this invention to disclose a method of installing a valve into a cylinder which has an internal, recessed land, comprising the steps of setting the valve into the cylinder; and inserting into the cylinder, and against an underlying surface of the valve, a valve retainer which has (a) means for upholding said valve within said cylinder, and (b) means for latchingly engaging the recessed land in said cylinder.

Additionally, it is an object of this invention to set out a method of forming a valve retainer, comprising the steps of providing a body which has an annulus subsisting in a given plane, and a plurality of elongate limbs projecting outwardly from said annulus in said plane; bending said limbs into substantially a normal disposition relative to said plane; and forming a bight, in each of said limbs, in adjacency to the free, terminal end thereof.

Figure 1:
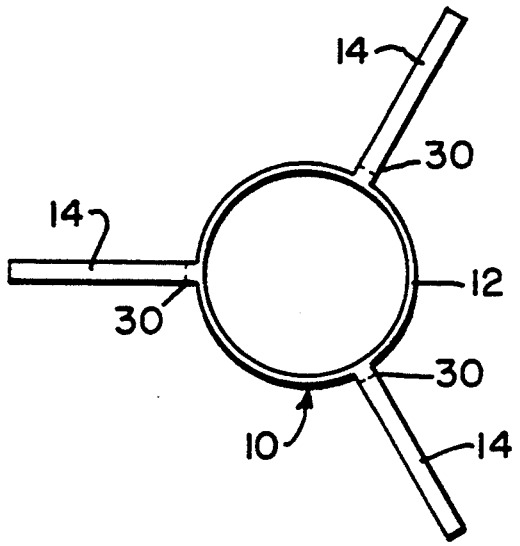
Figure 2:
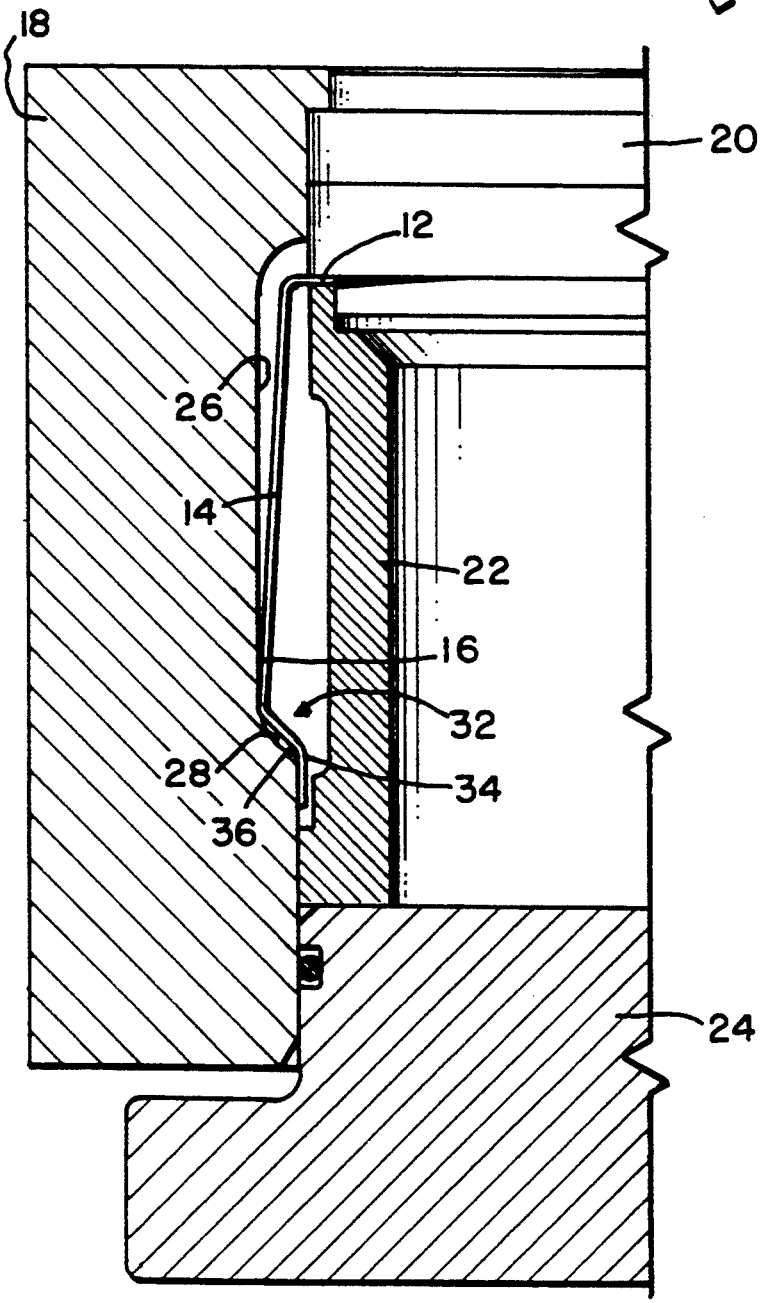

Further objects of this invention, as well as the novel features thereof, will become apparent by reference to the following description, taken in conjunction with the accompanying figures, in which:

FIG. 1 is a plan view of a blank for the novel valve retainer, according to an embodiment of the invention; and FIG. 2 is a vertical, cross-sectional view of half of a cylinder, valve, cage and valve cover, showing the valve retainer of FIG. 1 operatively in place.

As shown in FIG. 1, the blank 10 for the valve retainer comprises an annular body 12 which subsists in a given plane, i.e., the plane of the drawing, and has a plurality of elongate limbs 14, integral therewith, projecting outwardly therefrom in the same given plane. The limbs 14 are of equal length.

FIG. 2 shows the valve retainer 16, configured from the blank 10 of FIG. 1, in place in a cylinder 18, with a valve 20, cage 22, and cover 24. Only one of the limbs 14 is shown, but it is to be understood that all of the limbs 14 are identically configured.

The cylinder 18 has an internal, annular relief 26 which, as a consequence thereof, presents a land 28 fully about the inner surface of the cylinder 18. Each limb 14 is bent, into substantially a normal disposition relative to the plane of the body 12, at bend lines 30 (FIG. 1). They are not bent into exactly normal disposition; rather they are left slightly splayed out, as it is necessary that they resiliently engage the inner surface of the cylinder 18. Each limb 14 has a bight 32 formed therein, adjacent the free end thereof, in which there is presented a knee 34 which is inwardly directed, relative to the body 12. Formation of the bight 32, with the knee 34, presents a diagonal, latching surface 36 for engagement thereof with the land 28.

During manufacturing or servicing, the valve 20 is independently installed in the cylinder 18 with the retainer 16. Upon the valve 20 assuming its proper positioning, the latching surfaces 36 of the limbs 14 engage the land 28. Hence, the valve 20 is held in place. The body 12 is engaged with an underlying surface of the valve 20, and the splayed out, resilient limbs 14 are latched with the land 28.

Next, the cage 22 is installed, independently, and is set against the body 12, and within the limbs 14. Finally, the valve cover 24 is set into the cylinder 18, in abutting engagement with the cage 22, and fastened to the cylinder (by fasteners, not shown).

In accordance with this invention, then, the prodigious weights of the valve 20, and the cage 22, can be dealt with individually rather than together. The retainer 16, notwithstanding its efficiency, does not interfere with either the valve or the cage; neither does it inhibit the emplacement of the valve cover. Retainer 16 is quite unobtrusive, facile, and inexpensive to manufacture.

While I have described my invention in connection with a specific embodiment of a valve retainer, a method of forming the same, the retainer in combination with a cylinder, and a method of valve installation with the retainer, it is to be understood that this is done only by way of examples, and not as a limitation to the scope of the invention, as set forth in the objects thereof, and in the appended claims.

I claim:

1. In combination with a cylinder having an internal, recessed land, a valve retainer means, comprising:

first means, comprising a body, for supportingly engaging an underlying surface of a valve thereupon within such cylinder; and second means, integrally coupled to said body, for slidable insertion into the cylinder, said second means comprising means for latchingly engaging the recessed land with a snap-action engagement and for retaining said body against said underlying surface, and for maintaining the valve in said cylinder.

2. Valve retainer means, according to claim 1, wherein:

said first means comprises an annulus.

3. Valve retainer means, according to claim 1, wherein:

said second means comprises a plurality of elongate limbs.

4. Valve retainer means, according to claim 3, wherein:

each of said limbs has a bight formed therein in adjacency to an end thereof.

5. A method of installing a valve into a cylinder which has an internal, recessed land, comprising the steps of:

setting the valve into the cylinder; and inserting into the cylinder, and against an underlying surface of the valve, a valve retainer which has (a) first means for upholding said valve within said cylinder, and (b) second means, integral with said first means, for latchingly engaging the recessed land in said cylinder with a snap-action engagement, and retaining said first means against said underlying surface of the valve in said cylinder.

6. The method of claim 5, further including the steps of:

installing a valve cage into the cylinder and against the retainer; and fastening a valve cover to the cylinder and in engagement with the valve cage.

7. The method of claim 6, wherein:

said inserting step comprises inserting a retainer in which said upholding means comprises an annulus, and said engaging means comprises a plurality of elongate limbs; and said installing step comprises installing said cage within said limbs.

* * * * *